US005348204A

United States Patent [19]

Acedo

[11] Patent Number: 5,348,204

[45] Date of Patent: Sep. 20, 1994

[54] MORTAR SPREADING APPARATUS FOR THE LAYING OF BRICKS

[76] Inventor: Rafael M. Acedo, Espirall, 58, 08720 Vilafranca del Penedes, Barcelona, Spain

[21] Appl. No.: 34,714

[22] Filed: Mar. 22, 1993

[30] Foreign Application Priority Data

Mar. 27, 1992 [ES] Spain ..... 9200984

[51] Int. Cl.[5] ..... B67D 5/64

[52] U.S. Cl. ..... 222/611.1; 222/611.2

[58] Field of Search ..... 222/611.1, 611.2, 613, 222/191, 466; 401/5, 48, 193; 52/749; 33/404, 407, 409, 408

[56] References Cited

U.S. PATENT DOCUMENTS

| | | | |
|---|---|---|---|
| 3,163,881 | 1/1965 | Apicella | 401/5 |
| 3,203,021 | 8/1965 | Pelick | 401/5 |
| 3,319,283 | 5/1967 | Delligatti | 401/5 |
| 3,764,222 | 10/1973 | Orthman | 222/611.2 |
| 4,294,383 | 10/1981 | Hession et al. | 222/611.1 |
| 4,352,445 | 10/1982 | Cusumano et al. | 222/611.2 |

FOREIGN PATENT DOCUMENTS

| | | | |
|---|---|---|---|
| 2422159 | 11/1975 | Fed. Rep. of Germany | 401/193 |

*Primary Examiner*—Andres Kashnikow
*Assistant Examiner*—Philippe Derakshani
*Attorney, Agent, or Firm*—Ostrolenk, Faber, Gerb & Soffen

[57] ABSTRACT

A mortar spreading apparatus having a receptacle in the form of a bottomless box, a rearward side of the box extends outwardly such that an adjustable gap is formed between a lower edge of the rearward side and the top of a row of bricks being laid for dispensing a desired thickness of mortar. An indentation is formed on at least one lateral side of the box on an outer surface thereof so that the apparatus can be moved for the laying of bricks without displacing the position of an alignment cord used for aligning the bricks being laid.

8 Claims, 1 Drawing Sheet

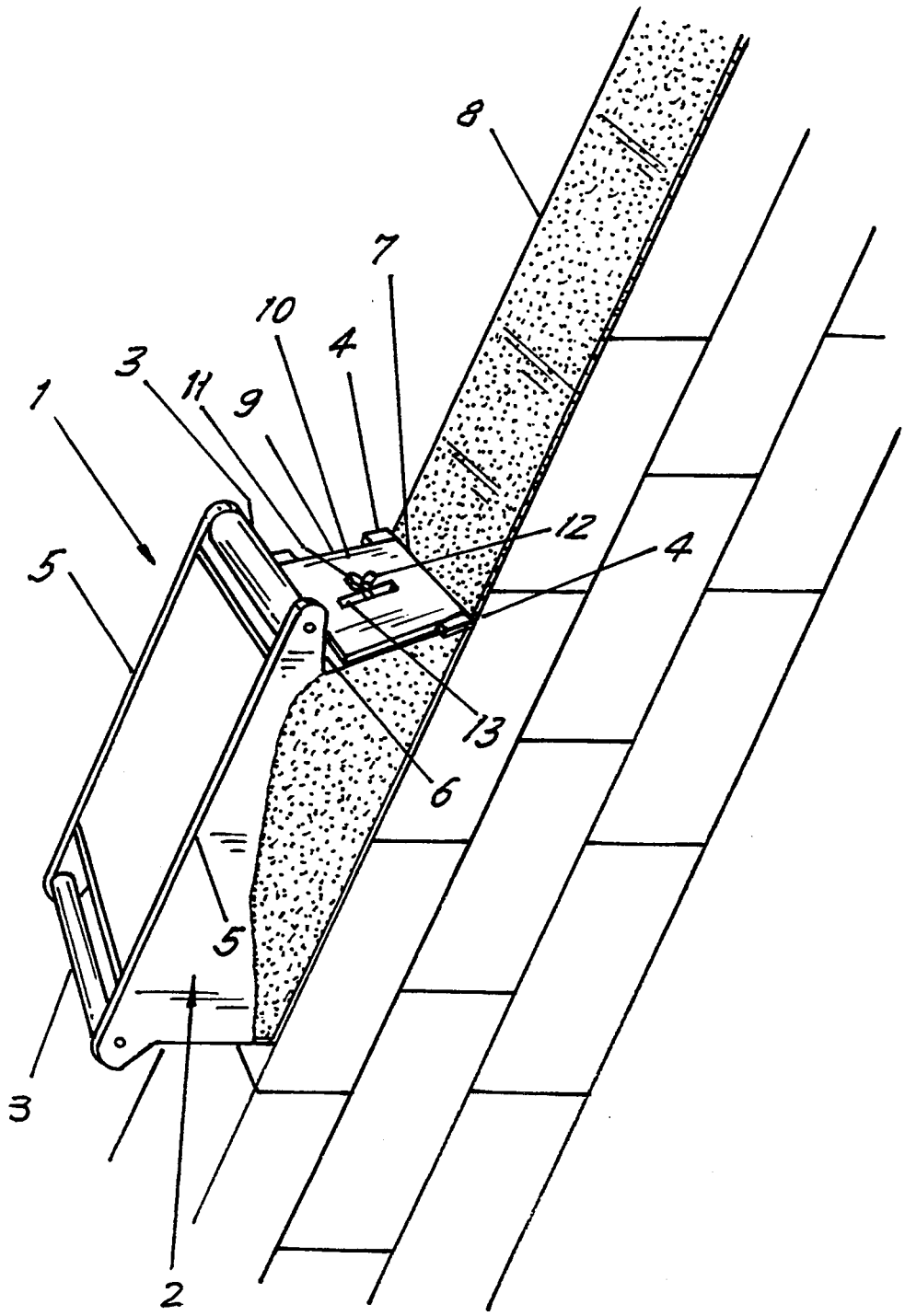
8
7
10
4
3
11
9
1
12
4
5
13
6
5
3
2

MORTAR SPREADING APPARATUS FOR THE LAYING OF BRICKS

BACKGROUND OF THE INVENTION

1. Field of the Invention

The present invention relates to a mortar spreading apparatus, in particular, a mortar spreading apparatus used for the laying of bricks.

2. Description of the Related Art

At the present time, for laying bricks in primarily horizontal rows, which constitute a wall or the like, it is necessary to pour the mortar on a row of bricks in a position which is normally tiring for the operator, and furthermore it results in a lengthy operation which affects the cost of the structure.

SUMMARY OF THE INVENTION

These and other drawbacks, such as large and incorrect use of the mortar, make the use of the apparatus of the present invention necessary.

The mortar spreading apparatus, of the present invention is simple to produce and to use. Furthermore, it is not necessary to be an expert in order to use it properly and, in addition, the existing problems mentioned above are cured by its use.

Therefore, the apparatus of the invention is considered a tool for the professional which constitutes an improvement in use, with the advantages indicated above.

In accordance with the invention, the mortar spreading apparatus is a receptacle in the form of a bottomless box which can be made of any suitable material, although it will preferably be made of wood, and it is provided with two handles arranged on the upper part of its facing sides, the handles facilitating the handling thereof.

The facing larger lateral faces are terminated at the lower part by angles which define resting guides on the row of bricks, for the longitudinal displacement of the apparatus.

On one of the lateral faces, the rear one with respect to the direction of displacement of the apparatus, there is a gap in the transverse direction, the height of which is defined by a height which it is desired to impart to the mortar which is spread.

This gap or opening is adjusted by a flap of adjustable position which, furthermore, regulates the discharge of the mortar.

This flap has an oblong central slot through which there passes a threaded shaft bearing a fastening wingnut in the manner that displacement of the flap makes it possible to regulate the amount of mortar and therefore the thickness thereof.

The inclination of the flap as well as of the face on which it is fastened and sits favors the discharge of the mortar.

On one lateral side, centered with respect to the height and in horizontal direction, there is a depression in the central region so that the spreader can be moved with the alignment cord in position.

The spreader therefore is designed to receive within it the mass which it collects in a bucket and as it is moved over the row of bricks discharges mortar through the gap or lateral opening mentioned above, in accordance with the uniform and preferably central thickness.

It is advisable that the structure be well wetted; in this way there is obtained good adherence of the mortar and it is avoided that it is torn away, the brick absorbing the water of the mortar.

In order more easily to understand not only the formation but also the proper use of the mortar spreading apparatus of the invention, one embodiment is described below, this embodiment being merely illustrative and in no way limitative of the invention, all as shown in the accompanying drawing.

BRIEF DESCRIPTION OF THE FIGURE

FIG. 1 is a perspective view of the mortar spreading apparatus according to the invention.

DETAILED DESCRIPTION OF THE PREFERRED EMBODIMENT OF THE INVENTION

Shown in FIG. 1, is a mortar spreading apparatus 1 formed by a prismatic body 2 in the form of a bottomless receptacle or box.

The apparatus 1 is provided with handles 3 as well as with angular terminations 4 at the end part of its lateral faces 5.

These angular terminations which define longitudinal guides are reinforced by metal.

On one of the lateral faces 6, in its lower part, there is developed a gap 7 through which a mortar which has been previously poured into the inside of the apparatus discharges.

The discharge of the mortar is uniform in the form of a layer 8, as shown in the drawing.

The angular terminations 4 which serve as guides facilitate the displacement of the apparatus over the row of corresponding bricks.

The corresponding lateral face 5 has in its center an indentation 9 to span the cord which is used for the alignment.

The gap 7 is regulated by a flap 10 arranged on the lateral face 6.

The lateral face 6 is inclined and forms an acute angle with the base of the apparatus. On the face 6 a bolt 11 is connected and fastened by means of a wingnut 12, the flap being provided with an oblong slot 13 by means of which the emergence of the mortar is regulated, causing the layer 8 to be thicker or thinner.

Having sufficiently described the nature of the invention as well as the manner of reducing it to practice, it should be pointed out that the arrangements described above and shown in the accompanying drawing are capable of changes in detail insofar as they do not alter its fundamental principle.

I claim:

1. A mortar spreading apparatus for the laying of bricks comprising a bottomless box having a top and a plurality of sides, one of said sides extending from said top outwardly of said box such that when the box is placed atop a row of bricks being laid, a predetermined gap is formed between a lower edge of said one side and the top of the row of bricks for dispensing a desired thickness of mortar, and at least one lateral side of the box having an indentation formed on an outer surface thereof, said indentation extending horizontally along the length of said at least one lateral side so that the apparatus can be moved for the laying of bricks without displacing the position of an alignment cord used for aligning the bricks being laid.

2. The mortar spreading apparatus of claim 1 in which said outwardly extending one side carries on a face thereof a plate, said plate being movable so as to adjust the height of said predetermined gap to obtain the desired thickness of mortar.

3. The mortar spreading apparatus of claim 2 having means to fix said plate to said one side at a desired position.

4. The mortar spreading apparatus of claim 3 having means to move said apparatus relative to a row of bricks.

5. The mortar spreading apparatus of claim 4 in which said means to move comprises a pair of handles disposed adjacent the top of the box.

6. The mortar spreading apparatus of claim 5 in which said box has a height which is greater than the height of a layer of mortar desired to be applied.

7. The mortar spreading apparatus of claim 5 in which said plurality of sides include lateral sides of the box, lower edges of the lateral sides of said box being adapted to cooperate with a layer of bricks and to be guided thereby.

8. The mortar spreading apparatus of claim 7 in which said means to fix said plates comprises a vertically arranged slot in said plate and said one side and at least one bolt adapted to pass through both slots simultaneously.

* * * * *